US006802757B1

(12) United States Patent
Sejnowski

(10) Patent No.: US 6,802,757 B1
(45) Date of Patent: Oct. 12, 2004

(54) DEVELOPMENTAL TOY

(75) Inventor: Joseph P. Sejnowski, North Kingstown, RI (US)

(73) Assignee: The First Years, Inc., Avon, MA (US)

( * ) Notice: Subject to any disclaimer, the term of this patent is extended or adjusted under 35 U.S.C. 154(b) by 0 days.

(21) Appl. No.: 10/427,325

(22) Filed: May 1, 2003

(51) Int. Cl.[7] ..... A63H 33/00
(52) U.S. Cl. ..... 446/227; 446/175; 446/484
(58) Field of Search ..... 446/227, 175, 446/484, 139, 142, 219, 485; 40/540, 541, 551, 572, 581, 427, 441–444

(56) References Cited

U.S. PATENT DOCUMENTS

| | | | | | |
|---|---|---|---|---|---|
| 778,916 | A | * | 1/1905 | Stumm | 40/442 |
| 946,669 | A | * | 1/1910 | Gill et al. | 446/147 |
| 2,399,121 | A | * | 4/1946 | Janson | 40/427 |
| 2,663,960 | A | * | 12/1953 | Cerracchio | 40/427 |
| 2,699,621 | A | * | 1/1955 | Levinson | 40/427 |
| 2,923,550 | A | * | 2/1960 | Blackman et al. | 273/157 R |
| 3,162,977 | A | | 12/1964 | Elischer | 46/189 |
| 3,440,349 | A | | 4/1969 | Gibbs | 179/1 |
| 3,666,936 | A | * | 5/1972 | Webster et al. | 40/444 |
| 3,790,772 | A | | 2/1974 | Newman et al. | 240/10 R |
| 3,806,722 | A | | 4/1974 | Peake et al. | 240/10 R |
| 4,642,710 | A | * | 2/1987 | Murtha et al. | 360/79 |
| 4,757,626 | A | * | 7/1988 | Weinreich | 40/427 |
| 4,882,865 | A | | 11/1989 | Andeweg | 40/442 |
| 4,934,940 | A | * | 6/1990 | Savery | 434/263 |
| 5,000,714 | A | | 3/1991 | Su | 446/392 |
| D325,404 | S | | 4/1992 | Jok | D21/64 |
| 5,654,705 | A | | 8/1997 | Houten et al. | 340/944 |
| 5,752,337 | A | * | 5/1998 | Chien | 40/540 |
| 5,782,698 | A | * | 7/1998 | Keller | 472/61 |
| 6,055,032 | A | | 4/2000 | Ousterhout et al. | 349/84 |
| 6,239,787 | B1 | | 5/2001 | Sugaya | 345/169 |
| 6,471,387 | B1 | | 10/2002 | Henshaw et al. | 362/555 |

FOREIGN PATENT DOCUMENTS

| | | |
|---|---|---|
| EP | 0662331 B1 | 6/1988 |
| EP | 0992268 A2 | 4/2000 |

* cited by examiner

*Primary Examiner*—Derris H. Banks
*Assistant Examiner*—Bena Miller
(74) *Attorney, Agent, or Firm*—Fish & Richardson, P.C.

(57) ABSTRACT

A toy includes a display component and an arrangement of opaque walls defining together with the display component a plurality of illuminable cavities separated from one another by the opaque walls. The opaque walls are disposed directly behind the display component. The illuminable cavities have associated light sources also disposed behind the display component and capable of illuminating the associated cavity to produce a corresponding visual effect visible from in front of the display component. At least two of the illuminable cavities are arranged to form multiple states of a single facial feature visible from in front of the display component with illumination states of the light sources of the cavities corresponding with the states of the facial feature that cooperate with other visible facial features to form a selection of discrete facial expressions.

29 Claims, 9 Drawing Sheets

DEVELOPMENTAL TOY

TECHNICAL FIELD

This invention relates to toys, and more particularly to developmental toys for small children.

BACKGROUND

It is a common objective to promote the intellectual development of small children and infants. One area of intellectual development is the recognition of facial features. Devices that include a grid-matrix liquid crystal display for producing visual display patterns have been suggested. Generally, the grid-matrix LCD constructs a display pattern with a relatively large number of evenly-spaced pixels.

SUMMARY

In an aspect, the invention features a toy that has a first housing. The toy includes a display component and an arrangement of opaque walls disposed directly behind the display component defining together with the display component a plurality of illuminable cavities separated from one another by the opaque walls. Associated light sources are disposed behind the display component and capable of selectively illuminating one or more of the illuminable cavities to produce a corresponding visual effect visible from in front of the display component. At least two of the illuminable cavities are arranged to form multiple states of a single facial feature visible from in front of the display component, with illumination states of the light sources of the illuminable cavities corresponding with the states of the facial feature that cooperate with other visible facial features to form a series of discrete facial expressions.

Implementations of this aspect may include one or more of the following features. For example, the opaque walls may be curved to define boundaries of the facial feature. The toy may include a second housing connected to the first housing along an edge, such as by a hinge, for placing the toy in a closed position.

In another aspect, the invention features a toy that includes sensor means for detecting a stimulus and generating a signal in response to the detection of the stimulus; means responsive to the signal for altering illumination states of a plurality of light sources; and means for displaying a plurality of discrete visual effects through a display component and visible from in front of the display component, the visual effects cooperating to form a facial expression that varies depending on the illumination states of the plurality of light sources.

In yet another aspect, the invention features a method of providing interactive entertainment for a small child that includes providing any of the toys described above; and altering the facial expression by changing the illumination state of at least one light source.

Implementations of this aspect include one or more of the following features. For example, the opaque walls may be curved to define boundaries of the facial feature. The toy may include a second housing connected to the first housing along an edge, such as by a hinge, for placing the toy in a closed position.

Implementations of any of the above aspects may contain one or more of the following features. The display component may be a two way mirror or the display component may be a frosted lens. Changing or varying the state of the facial feature to form a different facial expression may require changing or varying the illumination state of only one light source. Only two cavities may be arranged to form multiple states of the facial feature visible from in front of the display component.

In some cases, changing or varying the state of the facial feature to a different state to form a different expression may be in response to a signal. In these cases, the signal may be provided by one of a motion sensor, a heat sensor, a light sensor, a momentary switch and a sound sensor. A frequency of changing or varying the state of the facial feature among different states to form different facial expressions in response to the signal may depend upon the rate of input. Where this is the case, the frequency may increase with an increase in the rate of input and/or the signal may decrease with a decrease in the rate of input.

In some cases, a frequency of changing or varying the state of the facial feature among different states to form different facial expressions in response to the signal depends on the type of input selected from input selected from sensed motion, sensed sound, sensed light changes, sensed visual shape changes, sensed temperature changes and switch actuation.

In some embodiments, the facial feature forms an eye. The eye may have two or more states formed by selecting illumination states of a first eye cavity and a second eye cavity. In these cases, an open eye state may be formed by illuminating both the first and second eye cavities. An open eye state may also be formed by illuminating only the first eye cavity. A winking eye state may be formed by illuminating only the second eye cavity.

In some cases, the facial feature forms a mouth. In these cases, the mouth may have two or more states formed by selecting illumination states of at least two corresponding cavities of the mouth.

The toy may also include an attachment for attaching the toy to a crib with the display component being viewable by a user. In these cases, the attachment member may be a strap. An attachment may also be provided for hanging the toy from an overhang with the display component being viewable by a user. In these cases, the attachment may position the display component in either substantially horizontal or vertical positions. The toy may also include a stand for positioning the toy in a relatively upright position on a surface.

In some cases, the toy may also include a sound generating component for providing sound during operation.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
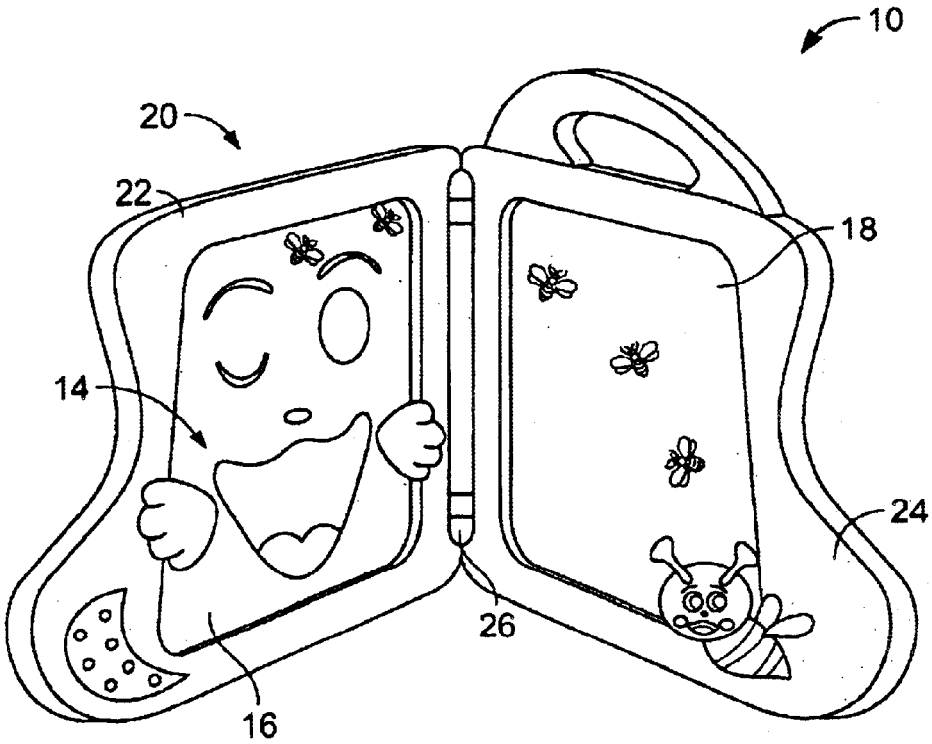
FIG. 1 is a front view of a toy having a hinged configuration.
Figure 1A:
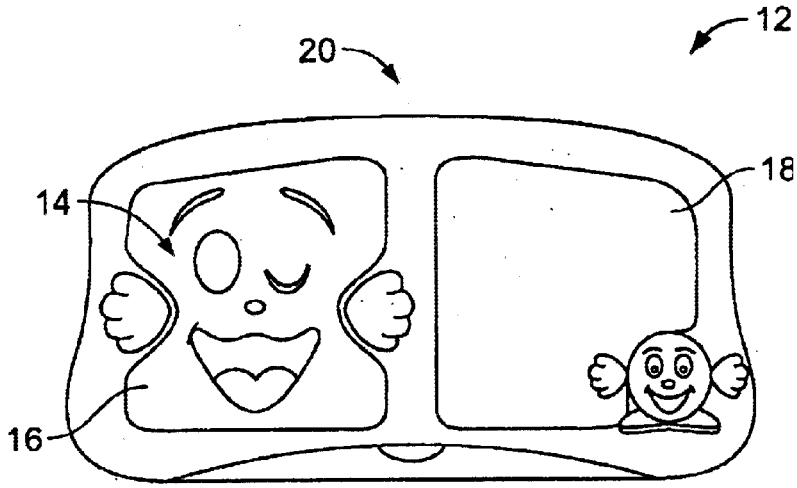
FIG. 1A is another embodiment of a toy.

FIGS. 1 and 1A illustrate embodiments of a developmental toy for an infant or small child. The toy provides interactive entertainment while furthering intellectual development of the child. At least one area of development targeted by the developmental toy is facial recognition. As discussed in greater detail below, the toy encourages such development by displaying a face 14 that is viewable by the child in a position from in front of toys 10, 12 (see, for example, FIGS. 6 and 7). The face 14 is projected through a wall of a display component 16, such as a two-way mirror or a frosted lens. The face 14 is composed of various facial features 18, such as a pair of eyes and eyebrows, a nose, a mouth and tongue. The facial features 18 cooperate with one another to form a distinct facial expression.

The facial expression of the face 14 changes from one facial expression to a different facial expression. As explained below, this is accomplished by changing a state of at least one of the facial features. By providing the face 14 with changing facial expressions, a level of interaction with the small child or infant can be achieved.

As illustrated by FIGS. 1 and 1A, toys 10, 12 have a front, viewing area and a rear, non-viewing area. Toys 10, 12 include a housing 20 that is designed to be suitable for use by a small child or infant. The housing 20 has first and second display components 16 and 18, each having a display surface, such as a frosted lens or a two-way mirror, as examples, formed of, e.g., plastic or any other suitable material. The display components 16 and 18 can be reflective, or have reflective characteristics, on one side (visible to the user) and are transparent or semi-transparent on the other side, such as, e.g., a two way mirror. In the alternative, the display components 16, 18 may be relatively non-reflective on one side and transparent or semi-transparent on the other side, such as, e.g., a frosted lens.

Figure 8:
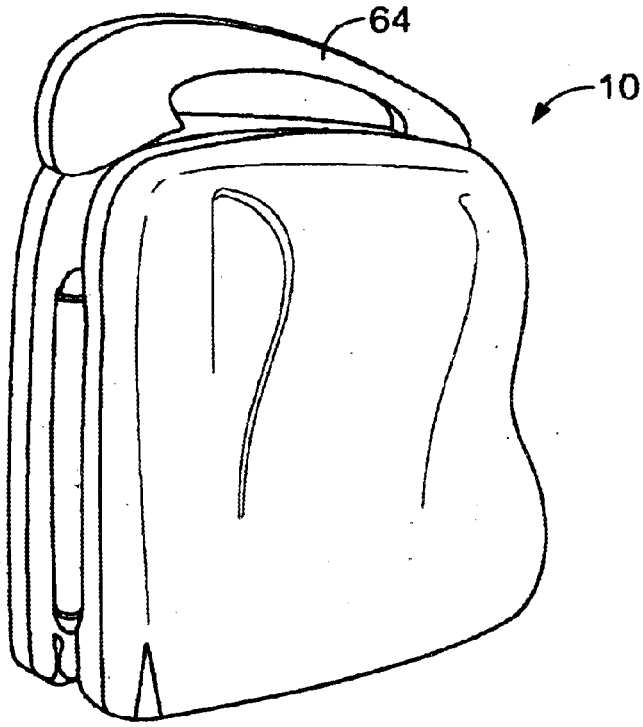
FIG. 8 is an illustration of the toy of FIG. 1 is a closed position.
Figure 9:
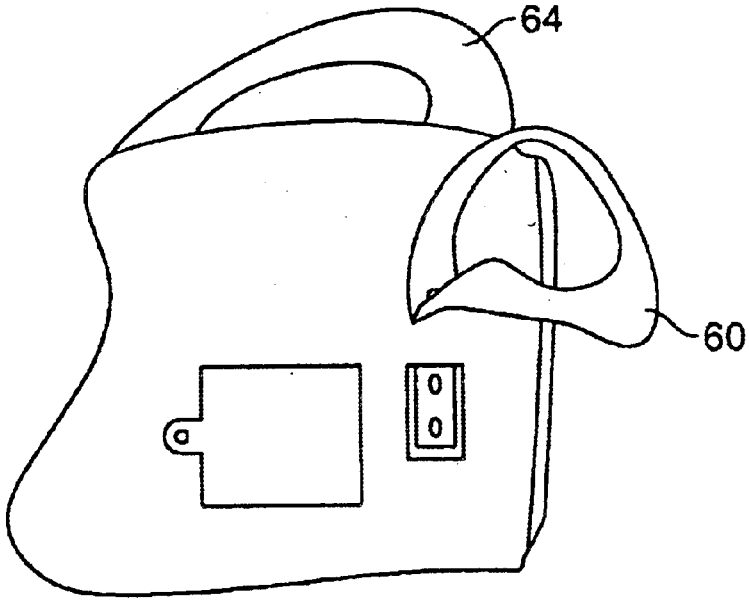
FIG. 9 is a rear view of the toy of FIG. 1 in a closed position.

Toy 10 of FIG. 1 is of a two-piece construction. The housing 20 includes a first housing part 22 that is hingedly connected to a second housing part 24 along an edge by a hinge 26. This two-piece construction allows for toy 10 to be placed in an open viewing position and a closed position (e.g., for storage or transport, see also FIGS. 8 and 9). As a variation and depicted by FIG. 1A, the toy 12 is of a single piece construction having a single housing member.

Figure 2:
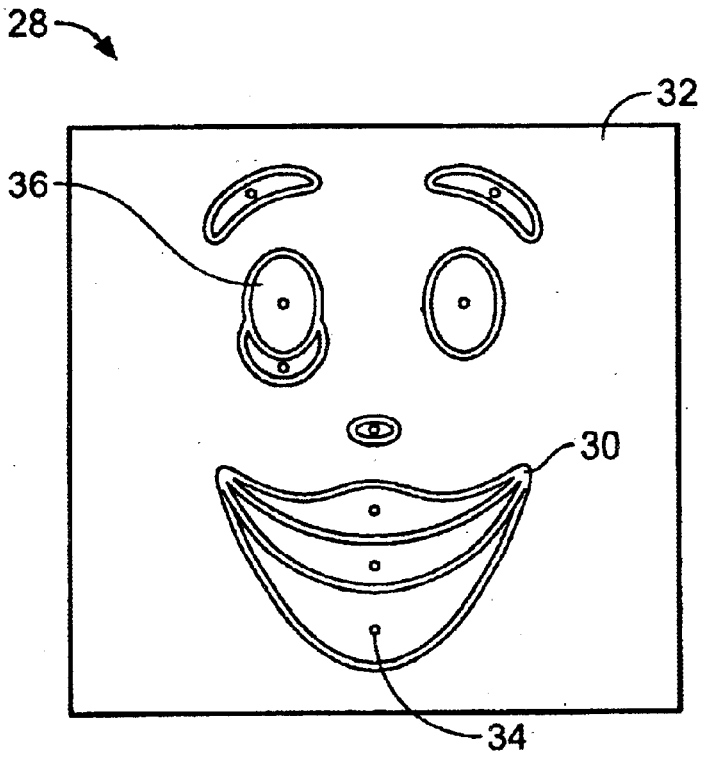
FIG. 2 is a front view of a backing with walls.
Figure 2A:
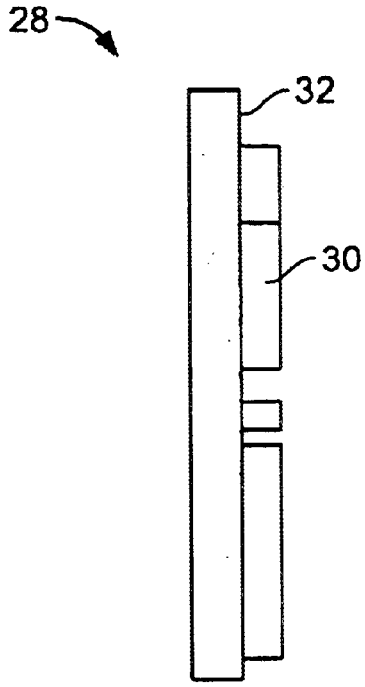
FIG. 2A is a side view of the backing of FIG. 2.

Referring now to FIGS. 2 and 2A a backing 28 having a surface 32 is shown that includes a series of opaque walls 30 extending outwardly therefrom. As can most clearly be seen in FIG. 3, the series of walls 30 form discrete bounded areas 36 of the backing 28. The backing 28 also includes openings 34 extending through backing 28 and positioned within the bounded areas 36. As an alternative, the opaque walls 30 can have openings 34.

Figure 3:
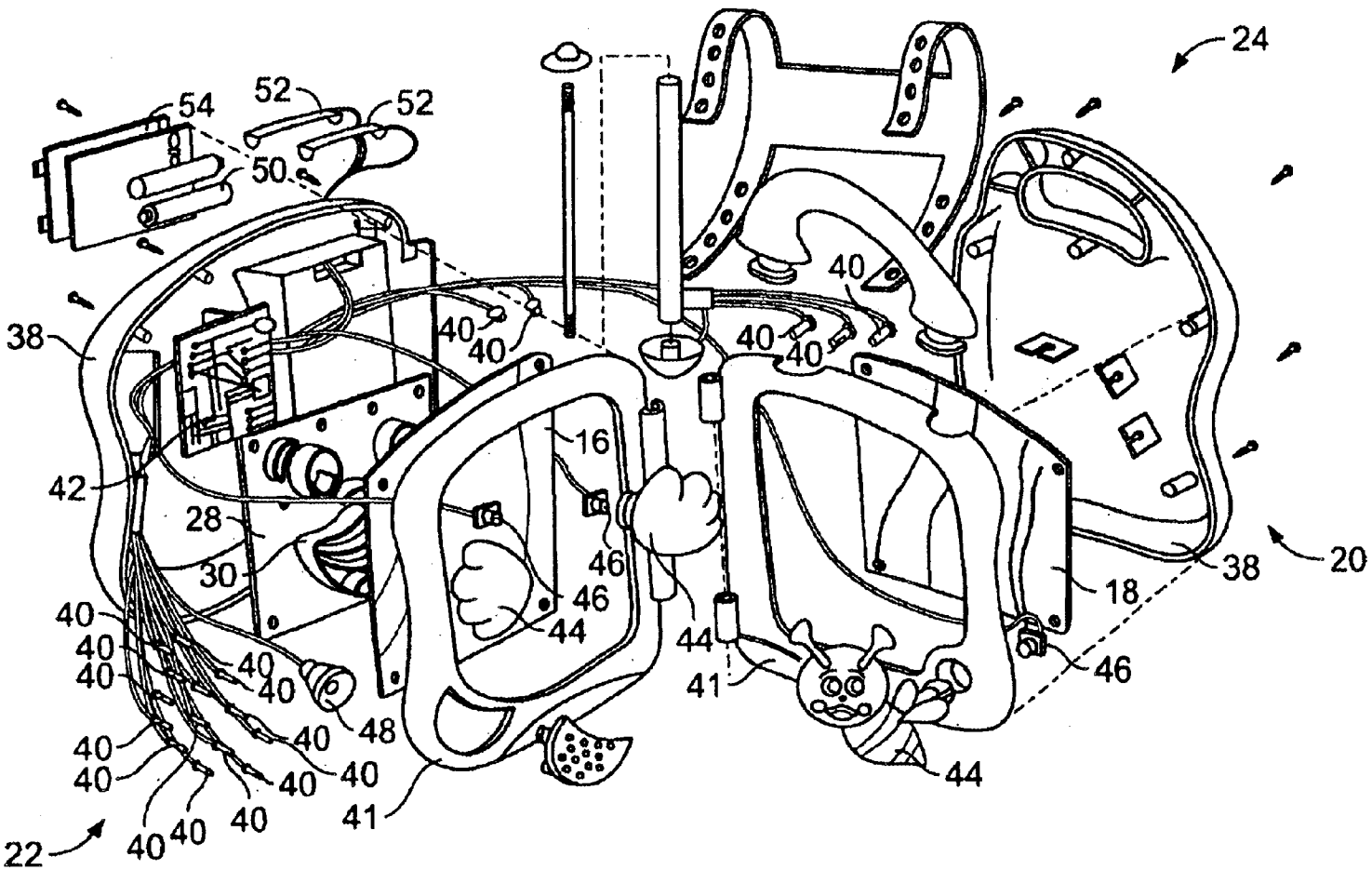
FIG. 3 is an exploded view of the toy of FIG. 1.
Figure 3A:
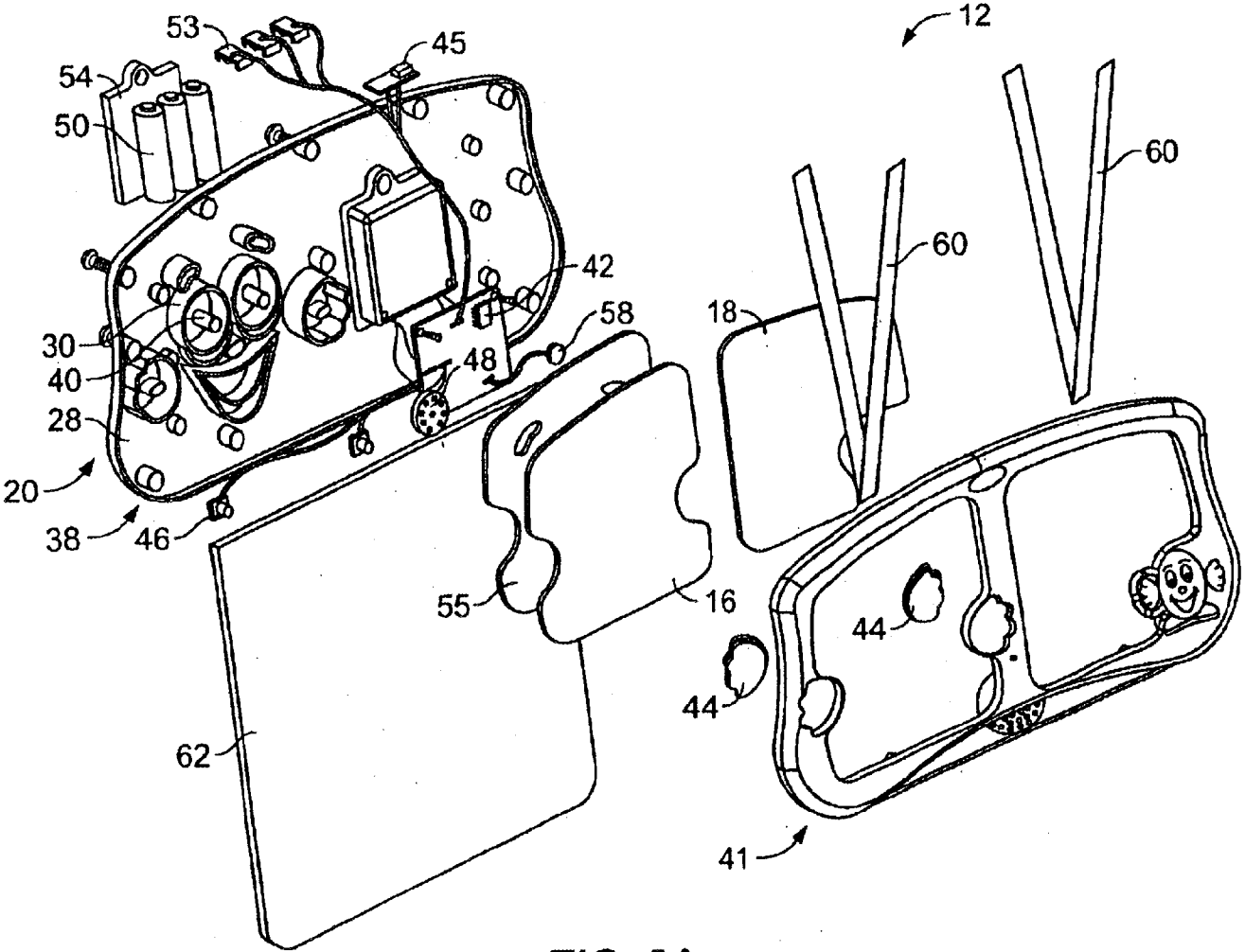
FIG. 3A is an exploded view of the toy of FIG. 1A.

FIG. 3 shows a relatively detailed exploded view of the toy of FIG. 1 and FIG. 3A shows a relatively detailed exploded view of the toy of FIG. 1A. Referring particularly to FIG. 3, as indicated above, housing 20 includes first housing part 22 and second housing part 24. Each housing part 22, 24 includes a rear member 38 and an interlocking frame member 41. The frame member 41 is configured to display the display component 16, 18. Positioned directly behind the display component 16, is the backing 28 having the series of opaque walls 30. Backing 28, opaque walls 30 and a rear surface of the display component 16 together form a series of relatively enclosed cavities.

Positioned within the cavities through openings 34 are light sources 40. Light sources 40 are capable of illuminating a respective cavity with the light in an illuminated state. The light sources 40 can be mounted within the openings 34, and/or the light sources can be mounted or positioned within respective cavities. In addition to light sources being positioned and/or mounted within the cavities and openings, light sources 40 are also placed behind the display component 18 within the second housing part 24 and behind buttons 44.

Referring now to FIG. 3A, toy 12, as described above, includes a single piece housing 20. The housing 20 includes a rear member 38 and an interlocking frame member 41. The frame member 41 is configured to display the display component 16, 18. The rear member 38 serves as backing 28 having an inner surface with the series of opaque walls 30 extending outwardly therefrom. Backing 28 or rear member 38, opaque walls 30 and a rear surface of the display component 16 together form a series of relatively enclosed cavities.

Referring also to FIG. 3, for visual effect, light emanating from light sources 40 is preferably of different colors. To achieve color variations, the light sources can be, for example, monochromatic of various wavelengths, such as a red light-emitting diode and/or light sources 40 can be coated with, for example, a colored gel or film, such as a white light coated with a blue film. In some cases, as an alternative, a filament 55 (see FIG. 3A), such as a green filament or a sheet having discrete areas of different colors, can be placed between the light 40 and the rear surface of the display component. Suitable visible colors include red, blue, green, white, purple, yellow, etc. Light sources 40 can also be all of the same color.

Light sources 40 are operatively connected to a control circuit or controller 42. The controller 42 is configured to control the illumination state of each individual light source 40. A user interface in the form of depressible buttons 44 and a slide switch 45 (see FIG. 3A) provides external interaction with controller 42. The buttons 44 are positioned to contact switches 46 that, upon contact or depression, send a signal to the controller 42, the effect of which will be described in greater detail below.

A sensor 58 (see FIGS. 3A and 4) is provided to supply a signal to the controller 42 upon detection of a stimulus, such as changes in light, temperature, image/object variations, such as, e.g., motion, and the like. Receipt of the signal from the sensor 58 affects the mode of the toy, which will also be described in more detail below.

A sound output device 48, such as a speaker, is also connected to the controller 42, which controls the output of the sound output device 48. Speaker 48 is adapted to output various sounds and/or music stored within, for example, a memory component of controller 42 depending, at least in part, on modes of the device and/or interactions of the child.

The electrical components, such as the controller 42, output device 48 and light sources 40, are powered by a power source 50. As illustrated, power source 50 consists of DC batteries, such as AA batteries. The batteries are positioned within sockets 52 (see FIG. 3) or leads 53 (see FIG. 3A), providing an electrical connection with the various electrical components of the toy 10. The power source 50 along with sockets 52 are positioned within rear member 38 and secured within the rear member 38 by a hatch 54. Hatch 54 is removable to provide access to the power source 50.

Housing 20, including rear member 38 and interlocking frame member 41, backing 28 and buttons 44 can be formed using a variety of manufacturing techniques such as molding including injection molding. Any number of shapes may be suitable for housing 20. In addition to the shapes depicted, the housing can be, e.g., star-shaped, head-shaped, such as a human head, shaped as a character, such as an animal or insect, etc. The housing can also be formed using a variety of suitable materials, but is preferably formed of a plastic, such as, e.g., thermoplastics and thermoset plastics including polypropylene, polyethylene, acrylic, polycarbonate, ABS, EVA, etc. Preferably, the rear member 38 and interlocking frame member 41 are permanently or semi-permanently connected by welding, adhesives, mechanical connections, such as beaded connections, snaps, detents, etc.

As described above, light sources 40 are positioned behind at least some of the buttons 44. These buttons 44 are formed of a transparent or semi-transparent material, preferably plastic, such as thermoplastics or thermoset plastics to allow for illumination of the button with the associated light in an illuminated state.

Backing 28 and sidewalls 30 are preferably formed of plastic such as, e.g., thermoplastics and thermoset plastics including polypropylene, polyethylene, acrylic, polycarbonate, ABS, EVA, etc., and can also be formed of any other suitable material. The walls 30 can extend integrally from the surface of the backing 28, or the walls and backing can be formed separately and later joined together by welding, adhesives, heat bonding, and the like, as examples.

Figure 4:
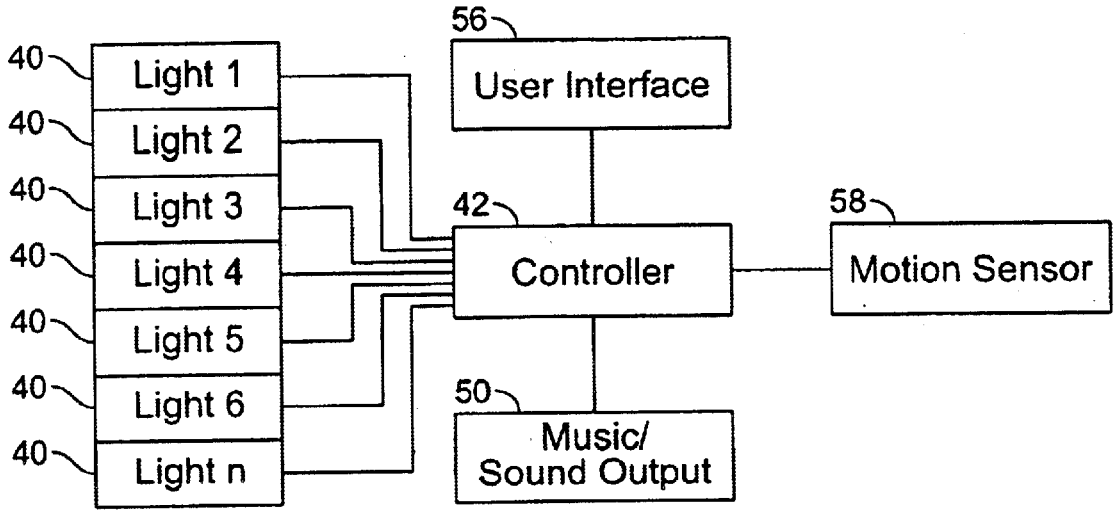
FIG. 4 is a schematic illustration of the operable components of the toy.

Referring now to FIG. 4 a simple schematic representation of the operative components of toys 10, 12 is shown. The user interface 56 allows a user to control modes of the toy 10, 12. Depending, at least in part, on mode selection, button actuation and/or motion detection by motion sensor 58, the controller 42 changes the illumination state of the individual light sources 40 (or a select group of light sources) and the output of sound output device 50. The controller can change the illumination state of individual light sources randomly, or, preferably, the illumination states of the light sources can be changed based on predetermined patterns that are stored in, for example, a memory component of the controller 42.

Figure 5:
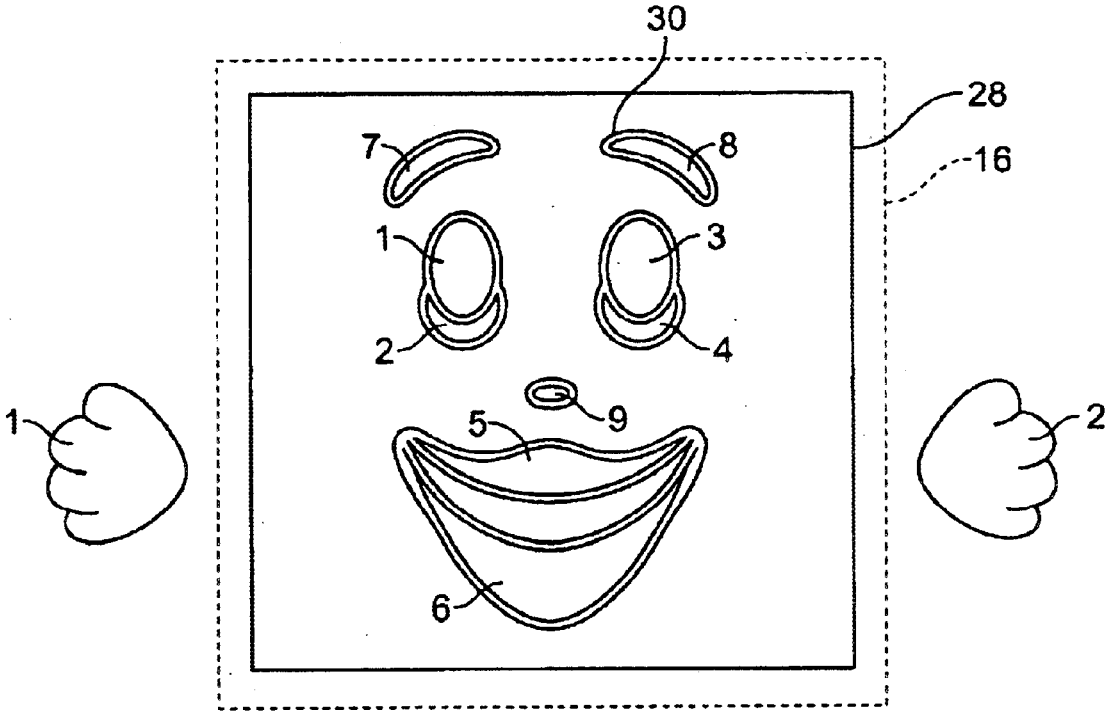
FIG. 5 is another front view of the backing with walls.
Figure 5A:
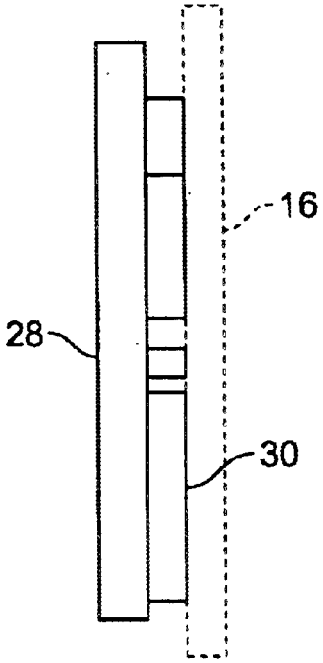
FIG. 5A is a side view of the backing with walls of FIG. 5.

The illumination state of light sources 40 that are housed within respective cavities correspond to an illumination state of the respective cavity. Each cavity serves to bound the diffusion of light emanating from the light source 40 to provide a discrete visual effect having smooth lines and curves viewable from in front of the display component. Referring to FIGS. 5 and 5A, illustrating another embodiment of the backing 28, it can be seen that at least two cavities cooperate to form some of the facial features. For example, cavities 1 and 2 cooperate to form facial feature states of the right eye. Similarly, cavities 5 and 6 cooperate to form facial feature states of the mouth of the face. Others of the facial features are formed by only one cavity. For example, cavity 8 forms the left eyebrow. Each of the individual facial features (e.g., eyes, eyebrows, nose and mouth) cooperates to form various facial expressions. Additionally, changing the illumination state of only one cavity can change the state of a corresponding facial feature, which in turn can change the facial expression.

FIG. 5 and Table I, below, provide an example of an electronics sequence that can be used with toys 10, 12. The element numbers of FIG. 5 correspond to light numbers in the following table. Light numbers 1 and 2 represent light sources positioned behind hand buttons. The hand buttons, upon depression, actuate momentary switches.

TABLE I

| |
|---|
| Motion Sensor Mode (Motion Sensor On) |
| If motion sensed more than 3 times within 5 sec, play SONG LIST A and initiate LIGHT SEQUENCE B<br>At each subsequent motion sensing (more than 3 times within 5 sec) alternate between SOUND LIST A and SOUND LIST B and initiate LIGHT SEQUENCE A<br>Monitor motion for 10 minutes |
| If no motion sensed for 10 min, shut down<br>Motion sensor is disabled while song lists and light sequences are playing |
| Button Activation Mode (Momentary Hand Switches) |
| When first turned on, play SOUND LIST B and initiate LIGHT SEQUENCE A<br>Play SOUND LIST A and initiate LIGHT SEQUENCE A<br>Immediately play SONG LIST B and initiate LIGHT SEQUENCE B<br>Wait for 10 sec<br>While waiting for 10 sec, flash hands 1 and 2 (0.2 sec on, 0.4 sec off)<br>At the first activation of either hand momentary switch, play SOUND LIST B, initiate LIGHT SEQUENCE A, and flash hands 1 and 2 (0.2 sec on, 0.4 sec off) for 10 sec<br>At each subsequent activation, alternate between the previous two actions<br>Pressing either momentary hand switch in mid-sequence starts next sequence<br>If no interaction within 5 min, shut down<br>Motion sensor inactive while in Button Activation Mode |
| Light Sequence A |
| All face lights on excluding 2, 4, and 6<br>Animate mouth talking (sec sound list) |
| Light Sequence B |
| All face lights on excluding 2, 4, and 6<br>Alternate through every 3 sec: |
| Animate eye winking (turn off 1 and turn on 2) for 0.4 sec<br>Animate eye blinking (turn off 1 and 3 and turn on 2 and 4) for 0.4 sec<br>Animate eye winking (turn off 3 and turn on 4) for 0.4 sec |
| Sound List A |
| "ICU5" (turn on 6, light every 0.3 sec for 0.2 sec starting at 0.1 sec)<br>"Play2" (turn on 6, light every 0.5 sec for 0.4 sec starting at 0.1 sec)<br>"LookAtMe2" (turn on 6, light every 0.2 sec for 0.1 sec starting at 0.1 sec)<br>"PeekaBoo6" (turn on 6, light every 0.3 sec for 0.2 sec starting at 0.1 sec) |
| Sound List B |
| "Giggle" (turn on 6, light every 0.2 sec for 0.2 sec starting at 0.1 sec<br>"Harp" (turn on 6, light for duration of sound |

The sound lists contain sounds preferably corresponding to the various facial expressions.

For example, referring to the sequence of SOUND LIST A, illumination of light #6 and sounds of the song list creates the effect of a talking face.

The toy 10, 12 is provided with a number of interactive modes. As described above in reference to Table I, the toys can be provided with a SENSOR MODE and a BUTTON MODE. The SENSOR MODE responds to motions of the child while interacting with the toy. The BUTTON MODE responds to actuation of the various buttons 44. Toys 10, 12 can also be configured to respond to a combination of button actuations and movements.

Figure 6:
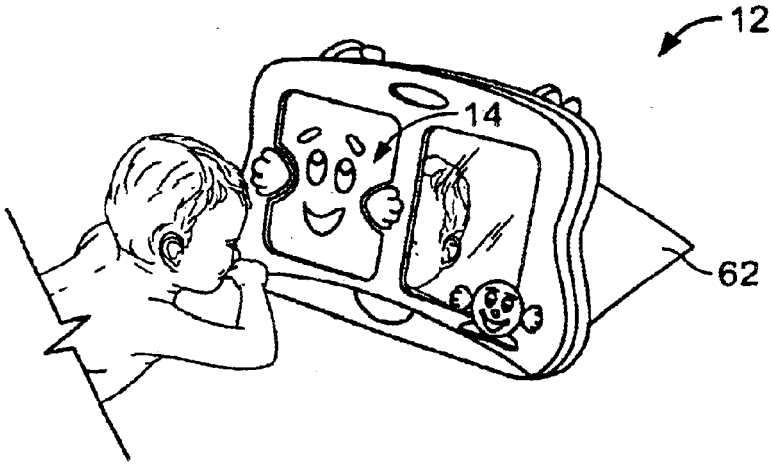
FIGS. 6 and 7 are illustrations of a child operating the toy of FIG. 1A.
Figure 7:
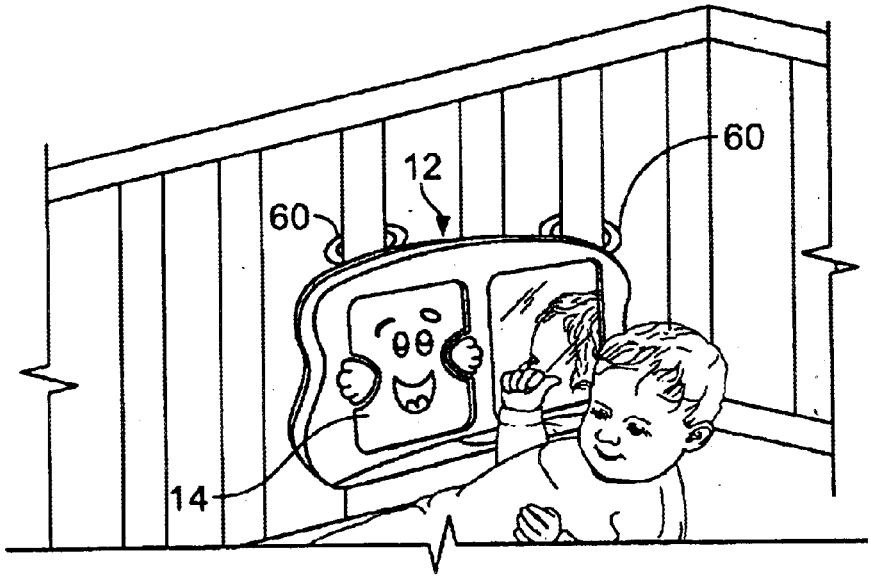
Figure 10:
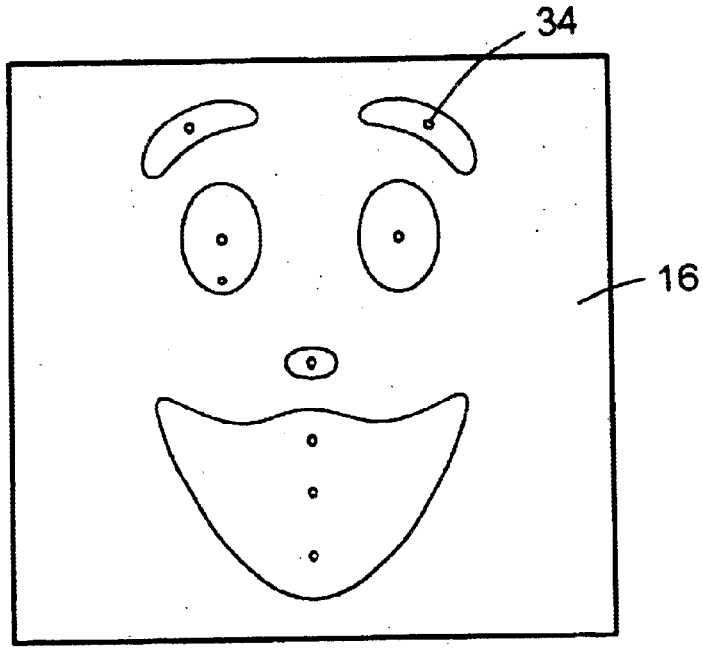
FIGS. 10 and 10A are front and side views, respectively, of an alternative embodiment of a display component of the toy having cavities extending from a rear surface of the display component.

Referring now to FIGS. 6 and 7, the toy can be configured to be attached to a crib and/or can be provided with a stand to be positioned relatively upright when placed on a surface, such as a floor. Referring particularly to FIG. 6, the toy is releasably attached to the crib by an attachment member 60, such as a strap (see also FIGS. 3A and 10), a clip, a clamp, and the like. Where a strap is used, the strap can be attached to the housing 20 between the rear housing member and the interconnecting housing member. The attachment member 60 can include engaging and mating elements forming, for example, snaps, buckles, etc. When attached to the crib, the toy is preferably in SENSOR MODE to respond to motions of the child placed within the crib.

Referring to FIG. 7, the toy is provided with a stand 62 configured to position the toy relatively upright (see also FIG. 3A). Preferably, the stand is formed as a one-piece member and then folded. To secure the stand 62 to the housing, shown most clearly by FIG. 3A, the stand 62, for example, can be attached between the interconnected rear housing member and interlocking housing member. The housing can be formed of any number of materials including, for example, textiles, plastics, or any combination thereof. In this position, the toy can be in either SENSOR MODE or BUTTON MODE. The toy can also be positioned horizontally on the ground for use without the stand 62.

Figure 10A:
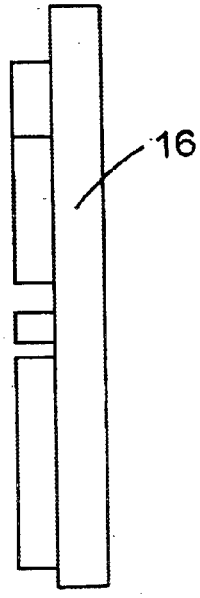

A number of embodiments of the invention have been described. Nevertheless, it will be understood that various modifications may be made without departing from the spirit and scope of the invention. For example, referring to FIGS. 10 and 10A, as an alternative to backing 28, the cavities having opaque walls 30 can extend from the rear surface of the display component 16. The toy can include a handle 64 to facilitate transport of the toy (see FIG. 8, for example). Accordingly, other embodiments are within the scope of the following claims.

What is claimed is:

1. A toy including a first housing comprising a display component;

disposed directly behind the display component, an arrangement of opaque walls defining together with the display component a plurality of illuminable cavities separated from one another by the opaque walls;

associated light sources disposed behind the display component and capable of selectively illuminating one or more of the illuminable cavities to produce a corresponding visual effect visible from in front of the display component; and at least two of the illuminable cavities arranged to form multiple states of a single facial feature visible from in front of the display component, illumination states of the light sources of the illuminable cavities corresponding with the states of the facial feature that cooperate with other visible facial features to form a series of discrete facial expressions.

2. The toy of claim 1, wherein the display component is a two-way mirror having a reflective surface.

3. The toy of claim 1, wherein the display component is a frosted lens.

4. The toy of claim 1, wherein the opaque walls are curved to define boundaries of the facial feature.

5. The toy of claim 1, wherein changing the state of the facial feature to form a different facial expression requires changing the illumination state of only one light source.

6. The toy of claim 5, wherein only two cavities are arranged to form multiple states of the facial feature visible from in front of the display component.

7. The toy of claim 1, wherein changing the state of the facial feature to a different state to form a different expression is in response to a signal.

8. The toy of claim 7, wherein the signal is provided by one of a motion sensor, a heat sensor, a light sensor, a momentary switch and a sound sensor.

9. The toy of claim 7, wherein a frequency of changing the state of the facial feature to different states to form different expressions in response to the signal depends upon a rate of input.

10. The toy of claim 9, wherein the frequency increases with an increase in the rate of input.

11. The toy of claim 9, wherein the frequency decreases with a decrease in the rate of input.

12. The toy of claim 7, wherein a frequency of changing the state of the facial feature among different states to form different expressions in response to the signal depends on a type of input selected from sensed motion, sensed sound, sensed light changes, sensed visual shape changes, sensed temperature changes and switch actuation.

13. The toy of claim 1, wherein the facial feature forms an eye.

14. The toy of claim 13, wherein the eye has two or more states formed by selecting illumination states of a first eye cavity and an adjacent second eye cavity.

15. The toy of claim 13, wherein an open eye state is formed by illuminating both the first and second eye cavities.

16. The toy of claim 13, wherein an open eye state is formed by illuminating only the first eye cavity.

17. The toy of claim 13, wherein a winking eye state is formed by illuminating only the second eye cavity.

18. The toy of claim 1, wherein the facial feature forms a mouth.

19. The toy of claim 18, wherein the mouth has two or more states formed by selecting illumination states of at least two corresponding cavities of the mouth.

20. The toy of claim 1, further including an attachment for attaching the toy to a crib, the display component being viewable by a user.

21. The toy of claim 20, wherein the attachment comprises a strap.

22. The toy of claim 1, further including an attachment for hanging the toy from an overhang, the display component being viewable by a user.

23. The toy of claim 22, wherein the attachment is configured to position the display component in a substantially horizontal position.

24. The toy of claim 1, further including a stand for positioning the toy in a relatively upright position on a surface.

25. The toy of claim 1 further including a second housing connected to the first housing along an edge.

26. The toy of claim 25, wherein the second housing is connected to the first housing by a hinge for placing the toy in a closed position.

27. The toy of claim 1 further including a sound generating component for providing sound during operation.

28. A method of providing interactive entertainment for a small child comprising providing the toy of claim 1; and altering the facial expression by changing the illumination state of at least one light source.

29. The method of claim 28, wherein altering the facial expression requires changing the illumination state of only one light source.

* * * * *